US006650304B2

(12) United States Patent
Lee et al.

(10) Patent No.: US 6,650,304 B2
(45) Date of Patent: Nov. 18, 2003

(54) INFLATABLE REFLECTOR ANTENNA FOR SPACE BASED RADARS

(75) Inventors: Jar J. Lee, Irvine, CA (US); William Derbes, Healdsburg, CA (US); Jonathan D. Gordon, Hawthorne, CA (US)

(73) Assignee: Raytheon Company, Lexington, MA (US)

( * ) Notice: Subject to any disclaimer, the term of this patent is extended or adjusted under 35 U.S.C. 154(b) by 78 days.

(21) Appl. No.: 10/086,211

(22) Filed: Feb. 28, 2002

(65) Prior Publication Data

US 2003/0160733 A1 Aug. 28, 2003

(51) Int. Cl.[7] ..... H01Q 15/20

(52) U.S. Cl. ..... 343/915; 343/912; 343/878; 343/881

(58) Field of Search ..... 343/878, 880, 343/881, 912, 915

(56) References Cited

U.S. PATENT DOCUMENTS 3,005,987 A * 10/1961 Mack et al. ..... 343/872
3,056,131 A * 9/1962 McCreary ..... 343/781 R
4,608,571 A * 8/1986 Luly ..... 343/781 P
4,672,389 A * 6/1987 Ulry ..... 343/915
5,132,699 A 7/1992 Rupp et al.
5,166,696 A 11/1992 Rupp et al.
5,579,609 A 12/1996 Sallee
5,990,851 A 11/1999 Henderson et al.
6,340,956 B1 * 1/2002 Bowen et al. ..... 343/915
6,344,835 B1 * 2/2002 Allen et al. ..... 343/915
6,353,421 B1 * 3/2002 Lalezari et al. ..... 343/915
6,417,818 B2 * 7/2002 Shipley et al. ..... 343/915
6,512,496 B2 * 1/2003 Alexeff et al. ..... 343/915
6,570,545 B1 * 5/2003 Snow et al. ..... 343/915

* cited by examiner

*Primary Examiner*—Don Wong
*Assistant Examiner*—Shih-Chao Chen
(74) *Attorney, Agent, or Firm*—Leonard A. Alkov; Glenn H. Lenzen, Jr.

(57) ABSTRACT

A space deployable antenna that includes an inflatable envelope, a cylindrical reflector formed on a wall of the envelope, a catenary support frame for maintaining the cylindrical shape of the cylindrical reflector, and a feed array support structure connected to the catenary support frame.

24 Claims, 3 Drawing Sheets

INFLATABLE REFLECTOR ANTENNA FOR SPACE BASED RADARS

TECHNICAL FIELD OF THE DISCLOSURE

The disclosed invention relates generally to antenna systems, and more particularly to an inflated reflector antenna structure.

BACKGROUND OF THE DISCLOSURE

Space deployable antenna structures include metal mesh designs that are heavy, bulky, difficult to package and deploy, and generally expensive to construct. Further, such mesh antennas would be difficult to implement as large antennas.

Other space deployable antenna structures include inflatable antennas wherein an inflatable structure forms a reflective surface. Known inflatable antenna structures have an antenna profile that tends to change, which impairs the properties of the antenna.

SUMMARY OF THE DISCLOSURE

An antenna is disclosed, which includes an inflatable flexible enclosed envelope having a curved wall transparent to RF, the curved wall ending at first and second opposing edges. An RF reflective coating is disposed on the curved wall. A catenary support frame supports the first and second edges and maintains the curved wall in a predetermined shape when the envelope is inflated. A support structure is provided to support a feed array illuminating the RF reflective coating with RF energy.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 2:
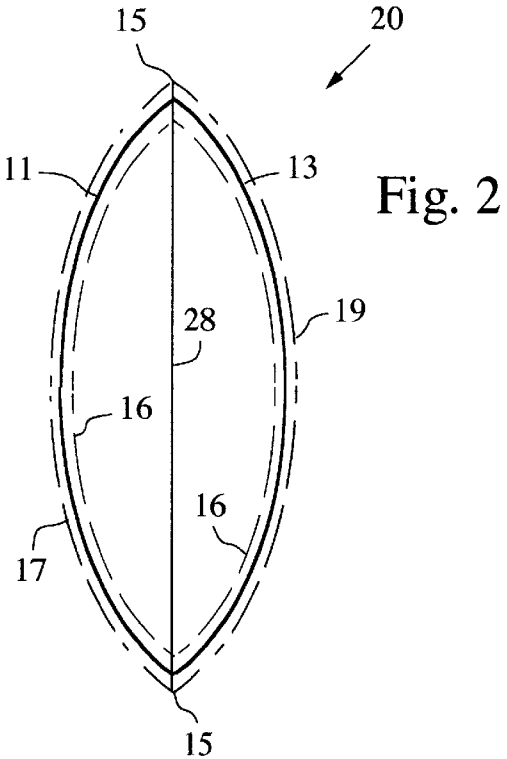
FIG. 2 is a schematic elevational cross-sectional view depicting the coatings on walls of an inflatable envelope of the antenna structure of FIG. 1.
Figure 1:
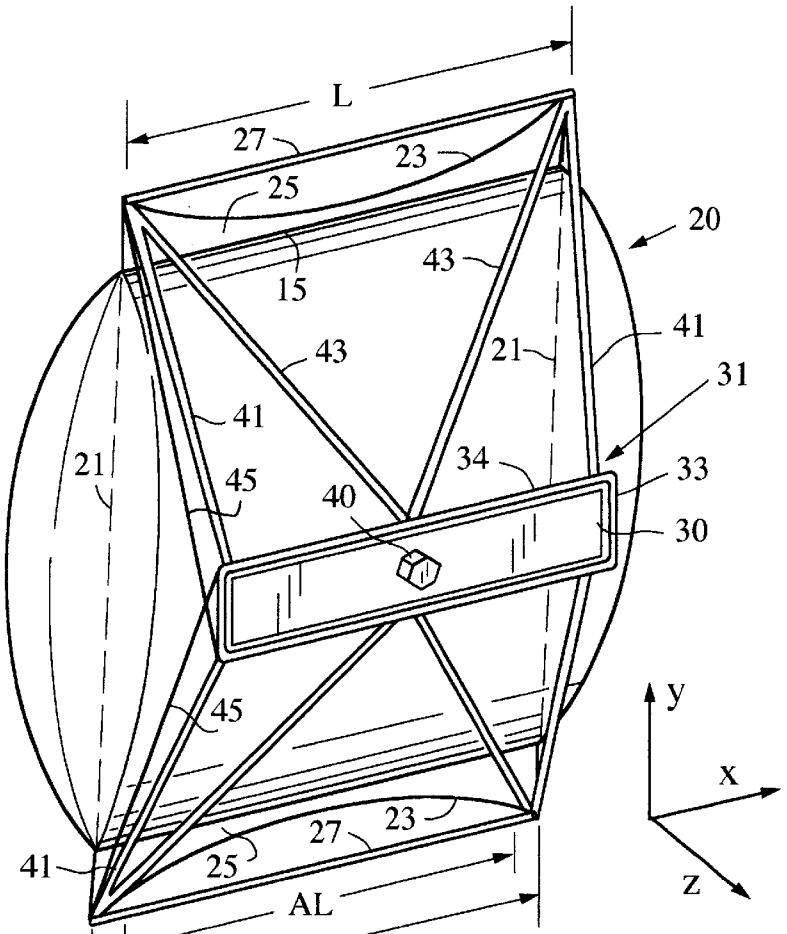
FIG. 1 is a schematic perspective view of an antenna structure in accordance with the invention.

FIG. 1 illustrates an exemplary embodiment of an inflatable antenna structure in accordance with aspects of the invention. FIG. 1 is a schematic perspective view of an inflatable antenna structure that generally includes a pillow shaped inflatable envelope 20 formed of a thin flexible RF transparent plastic membrane, such as 0.3 mil thick Kapton (TM), and having a rear curved wall 11 and a front curved wall 13 (FIG. 2). The shape of the inflatable envelope is maintained by inflating gas and a catenary and strut frame as described further herein. An X-band and L-band feed array 30 and a bus 40 are supported in front of the front curved wall 13.

Referring now to FIG. 2, an RF transparent, high emissivity black coating 16, such as an ink coating, is disposed on the inside of the rear and front walls 11, 13 to lower thermal gradients over the reflector enough such that wall thermal expansion variations are low enough for acceptable reflector surface accuracy and therefore acceptable RF performance. An RF reflecting coating 17 is disposed on the outside of the rear curved wall 11, while an RF transparent solar energy reflective coating 19 can be disposed on the front curved wall 13. The RF reflecting coating 17 can be for example a plurality of metallized layers for RF reflection.

In this exemplary embodiment, the front and rear curved walls are cylindrical and have parallel cylinder axes. The front and rear curved walls therefore intersect and are joined along substantially parallel opposing edges 15 which for reference can be considered as being horizontal and along an X-axis of an XYZ coordinate system as shown in FIG. 1. The interface between the RF reflecting coating and the rear wall 11 thus forms a reflector having a circular cross section in the elevation plane (EL) which is parallel to the YZ plane.

The cylindrical contour in the elevation plane is maintained by gas pressure, and Y-axis reflector struts 21, each located between opposing ends of the edges 15, absorb cylindrical flattening forces. The Y-axis reflector struts are parallel to the Y-axis and can more particularly be inflatable, non-conductive, rigidizable tubes.

The reflector surface is flattened off-cylindrical by catenary hanger structures along the horizontal or X-axis. Each catenary hanger structure includes, for example, a catenary wire 23 and a catenary mesh web or membrane 25 that are connected between an edge 15 and ends of an X-axis strut or longeron 27 that absorbs an X-axis force created by the catenary hanger structure. Each catenary wire 23 is more particularly connected along its length to a contoured edge of the membrane 25 that maintains an accurate shape in the wire. The opposing edge of the membrane 25 is linear, and connects to the junction of the curved walls 11, 13. The wire 23 and the membrane 25 are preferably made of low coefficient of thermal expansion materials to maintain an accurate shape in the wire at expected temperatures.

A micrometeriod shield 28 (FIG. 2) is disposed in the envelope 20 and extends between the opposing edges 15, and can also assist in maintaining linearity of the edges 15. The shield 28 comprises a membrane such as 0.25 mil thick Mylar (TM) to absorb or slow down the fragmented pieces of a micrometeor that penetrates one of the curved walls, mitigating damage and the resulting inflatant leak rate that would otherwise occur as the fragments impact one of the curved walls on the way out of the envelope.

Figure 3:
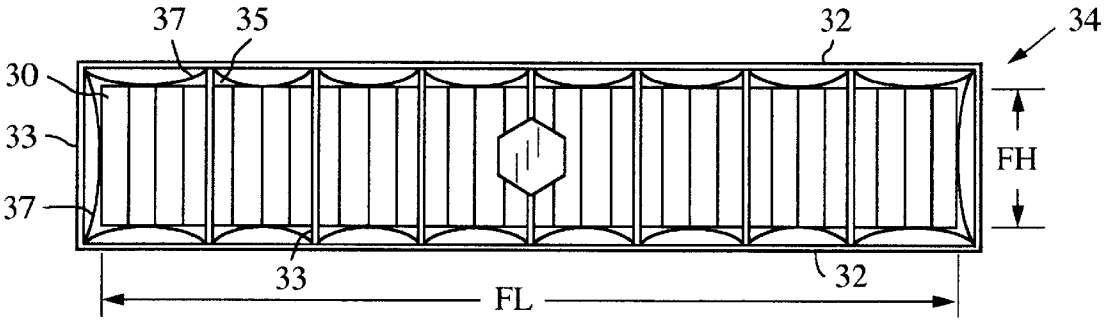
FIG. 3 is a schematic elevational view of the feed array support structure of the antenna structure of FIG. 1.

Referring now to FIG. 3, the feed array 30 is supported along the horizontal and vertical axes by a feed array support structure 31 comprising a catenary frame 34 that includes X-axis or horizontal feed longerons 32 on opposite sides of the feed array 30 and plurality of vertical cross-bars 33 that span between the longerons 32. Catenary hanger structures comprising catenary wires 37 and catenary mesh web or membrane 35 are disposed between an edge of the feed array 30 and the catenary frame 34. The catenary wires 37 are suspended at the interconnections of the X-axis feed longerons 32 and the cross-bars 33, and each is connected along its length to a contoured edge of an associated catenary membrane 35 that has an opposing linear edge attached to an edge of the feed array. The catenary wires 37 and the catenary membranes 35 can be made of low coefficient of thermal expansion fibers to maintain a near accurate shape at expected operating temperatures.

The feed array 30 in an exemplary embodiment is a Z-folded structure, fabricated on a flexible dielectric substrate such as a flexible circuit board structure to permit the folding. Rows and columns of radiating elements are fabricated on the substrate, and can comprise RF patch elements. Each column is aligned in the Y-axis, with the rows aligned in the X-axis.

The feed array assembly comprising the feed array 30 and the catenary supporting frame 34 is connected to the reflector supporting frame by a pair of W-trusses, each comprising outer struts 41 (FIG. 1) connected between the ends of the feed array longerons 32 and the ends of the reflector longerons 27 and diagonal struts 43 connected between the centers of the feed array longerons 32 and the ends of the reflector longerons 27. Support wires 45 are connected between ends of the feed array longerons 32 and corresponding ends of the reflector longeron 27 that are further away vertically. These wires provide for stiffening against shearing.

The longerons, struts, and cross-bars of the antenna structure preferably comprise rigidizable collapsed elements that are extended and rigidized when the antenna structure is deployed in space, for example by jettison from a launch vehicle such as an Atlas II rocket, using an expanded payload fairing. For example, the reflector longerons 27 can comprise inflatable, rigidizable members. The reflector Y-axis struts 21 and the diagonal struts 43 comprise inflatable, rigidizable, Z-folded members. The feed X-axis longerons 31 and the outer struts 41 can comprise inflatable, rigidizable members. The feed cross-bars 33 can comprise inflatable, rigidizable, Z-folded members.

Figure 4:
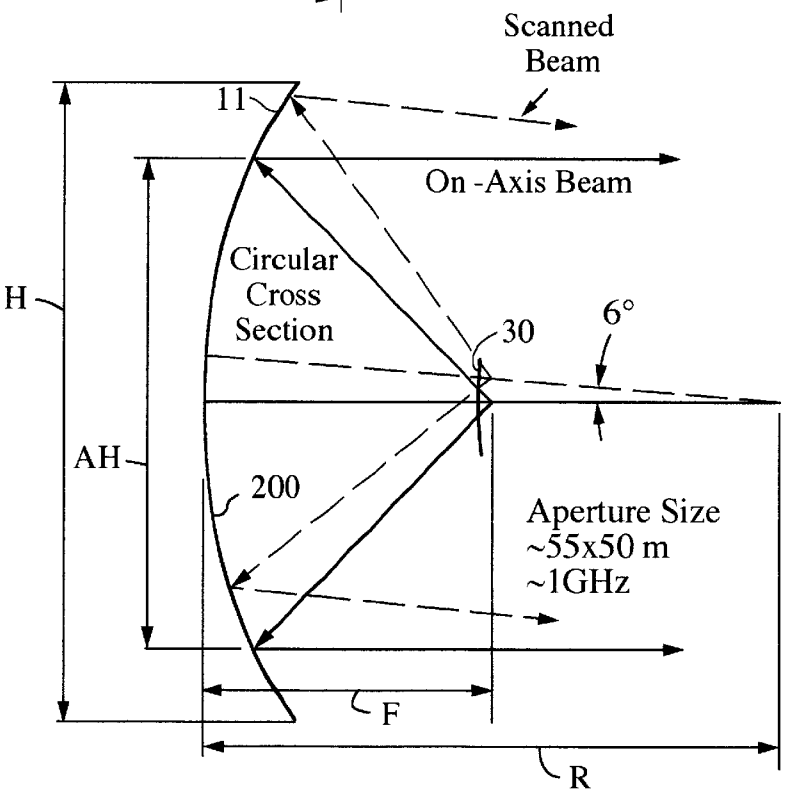
FIG. 4 is a schematic elevational view illustrating the operation of the antenna structure of FIG. 1.

Referring now to FIG. 4, the rear curved surface 11 of the inflated envelope 20 and the RF reflective coating 17 thereon form a cylindrical reflector 200 of circular cross section having for example a radius R of about 55 meters. The reflector 200 can be oversized to support elevation (EL) and azimuth (AZ) scans. For example, the reflector is about 65 meters in height H (FIG. 4) in the elevation plane which is parallel to the YZ plane and 60 meters in length L (FIG. 1) in the azimuth plane which is parallel to the XZ plane. The following are examples of parameters for one exemplary antenna system that employs such a reflector.

| | |
|---|---|
| Frequency | 1 GHz |
| Bandwidth | 5% |
| AZ Beam width | 0.3 Deg |
| EL Beam width | 0.3 Deg |
| Scan Volume | +/− 6 Deg AZ, +/− 6 Deg EL |
| Power-Aperture | 30,000 KW $m^2$ |
| Prime Power | 32 KW |
| Satellite Altitude | Medium Earth Orbit |
| Volume | To Fit in Atlas II |
| Mass | <1100 Kg |

For this exemplary embodiment, the active feed array 30 is about 50 meters in length FL and about 1 meter in height FH, and for reasons discussed further herein is more particularly located about half way between the vertex of the reflector 200 and the center of the circular antenna. Ideally, the feed array 30 is supported on a radial arc equal in radius to that of the reflector 200, but for many applications, a planar feed array can be employed. To produce the specified azimuth beam width of 0.3 degree at L-band, an aperture length AL (FIG. 1) of about 50 meters in the azimuth plane is employed. For the elevation plane, however, a slightly greater aperture height AH (FIG. 4) of about 55 meters can be selected to offset the broadening effect caused by the blockage of the feed array. An aperture taper of 10 dB is imposed in both the elevation and azimuth planes to control the side lobes.

Beam scan in the elevation plane is accomplished by "rocking" (rotating) the beam with respect to the center of the circular reflector. This is done by selectively turning on/off some of the radiating elements at the top and bottom of the feed array in the Y-axis. The number of radiating elements in the Y-axis needed for operation at a given pointing direction is fewer that the number of elements forming each column. By electronically selecting the particular elements used for a particular beam in the Y-axis, e.g., by use of a commutation switch network, the beam can be rotated or scanned over a limited beamwidth. As the beam scans off axis ±6 degree in the elevation plane relative to the on-axis beam, the illumination pattern of the array feed will move up and down by about 5 meters, and a reflector height H (FIG. 4) of about 65 meters is selected to capture all the scanned beams.

This exemplary embodiment provides the following features. Circular symmetry provides uniform scan performance in the EL scan. Linear geometry in the AZ plane minimizes the packaging, deployment, and feed design. Cylindrical instead of spherical geometry reduces power density of the transmit modules. Symmetrical and cylindrical configuration greatly simplifies inflatable design and fabrication, and hence substantially reducing overall cost.

Ray optics shows that the focal length F of a circular reflector is about one half of its radius. Thus, a first step in the design of the exemplary embodiment is to select a proper radius for a given aperture size, which is constrained by the specified EL beam width. A long focal length F reduces aberration, (phase errors) and the focal spot size, which also results in a better-behaved (smooth) phase front in the focal region. A more uniform phase distribution is easier to match, and a small, but not too small, focal spot is desired because it requires fewer rows of radiating elements to receive the focused beam.

On the other hand, a long focal length F will offset the focal spot far away from the axis for the EL scan, which increases the feed size and the number of radiating elements required to populate the feed array. This will complicate the design of the commutation switch, which is used to shift the power to the active region of a moving focal spot. Moreover, it also increases aperture blockage, causing gain drop and side lobe degradation due to the scattering of the feed array.

The optimum focal point for this exemplary embodiment is chosen to balance the spot size, power density of the focal region, the feed height, and the maximum aperture blockage allowed. The design guideline for this embodiment is to keep the feed less than 8 m in height, and a focal spot size around ~1.5 m using a −10 dB truncation point. It was found that an optimum focal length F for this design is about 26 meters from the vertex of the reflector 200.

Figure 7:
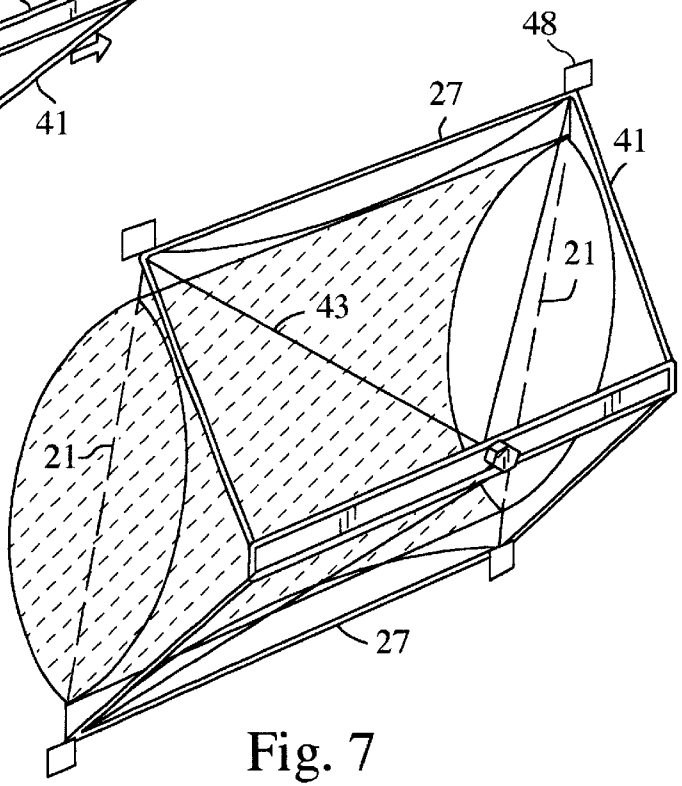
FIG. 7 is a schematic view illustrating another stage in the deployment of the antenna structure of FIG. 1.
Figure 6:
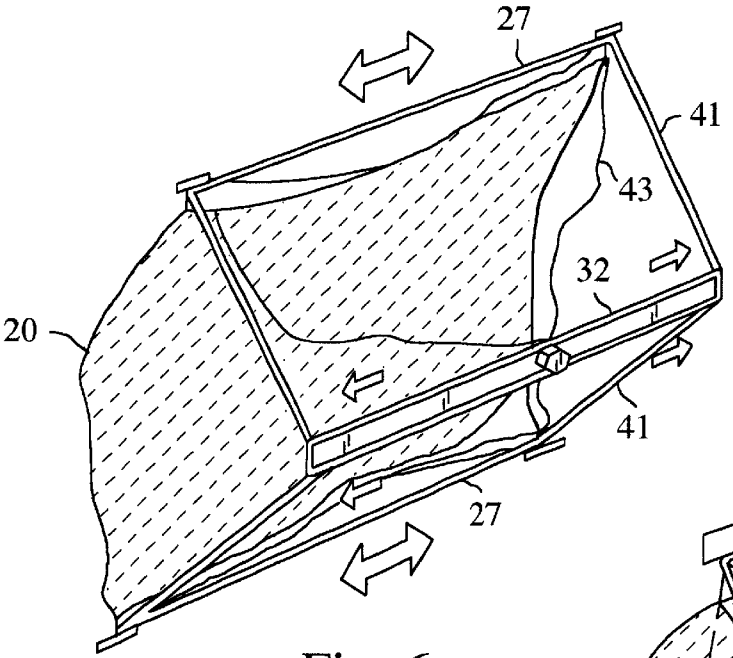
FIG. 6 is a schematic view illustrating a further stage in the deployment of the antenna structure of FIG. 1.
Figure 5:
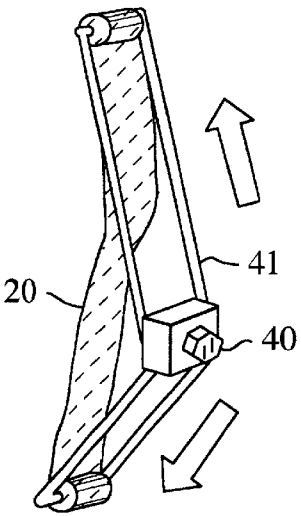
FIG. 5 is a schematic view illustrating a stage in the deployment of the antenna structure of FIG. 1.

Referring now to FIGS. 5–7, the packaged antenna structure is deployed as follows, for example after jettisoning of a container that contained the collapsed antenna structure. The outer W-struts 41 are telescopically deployed via inflation to separate the feed array and the feed support structure from the inflatable envelope 20, as depicted in FIG. 5. Pursuant to such deployment, the double Z-folded envelope 20 unfolds in the Y-axis, the Z-folded enclosed struts 21 deploy freely, and the Z-folded diagonal W-struts 32 deploy freely.

The X-axis feed longerons 32 and the reflector longerons 21 are then deployed via inflation, as depicted in FIG. 6. Pursuant to this deployment, the envelope 20 unfolds along the X-axis, and the bi-folded, Z-folded feed array 30 is deployed.

The feed crossbars are inflated to tension the feed array 30, and the enclosed Y-axis reflector struts 21 and the diagonal struts 3 are inflated to complete deployment of the tubular longerons, struts, and cross bars. The envelope is then inflated, which will provide shear strength and maintain needed tolerances, and the tubular longerons, struts and cross bars are allowed to rigidize. The tubes are then evacuated through null jets. Solar panels 48 are also deployed to provide electrical power.

While this invention has been described in the context of an exemplary embodiment with exemplary frequency and size parameters, it is to be understood that the invention is not limited to the particular parameters set out above, and can be employed for other applications and frequency regimes. The antenna can for example be employed in multi-band, co-aperture applications, at various orbit locations, and can provide service in such applications as synthetic aperture radar, space-based radars and the like.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An antenna comprising:

an inflatable flexible enclosed envelope having a cylindrically curved wall transparent to RF, said curved wall ending at first and second opposing edges;

an RF reflective coating disposed on said curved wall;

a reflector catenary support frame for supporting said first and second edges and for maintaining said curved wall in a predetermined shape when said envelope is inflated; and a feed array support structure including a catenary feed support frame for supporting a feed array at a reflector focal location for illuminating said RF reflective coating with RF energy.

2. The antenna of claim 1 wherein said reflector support frame includes rigidizable components.

3. The antenna of claim 1 wherein said feed support frame includes rigidizable components.

4. The antenna of claim 1, wherein said feed array support structure further includes a truss structure connecting between said feed support structure and said reflector catenary support frame for supporting the feed support frame at said focal location.

5. The antenna of claim 4 wherein said truss structure includes rigidizable components.

6. The antenna of claim 1 wherein said curved wall is configured to support an aperture that is about 55 meters in height and about 50 meters in length.

7. An antenna comprising:

an inflatable flexible enclosed envelope having a cylindrical wall transparent to RF;

said cylindrical wall ending at first and second opposing edges;

an RF reflective coating disposed on said cylindrical wall;

a catenary reflector support frame for supporting said first and second edges and for maintaining said cylindrical wall in a cylindrical shape when said envelope is inflated; and a catenary feed array support structure connected to said catenary support frame for supporting a feed array at a reflector focal location for illuminating said RF reflective coating with RF energy.

8. The antenna of claim 7 wherein said catenary reflector support frame includes catenary supports.

9. The antenna of claim 7 wherein said catenary reflector support frame includes rigidizable components.

10. The antenna of claim 7 wherein said catenary feed array support structure is foldable.

11. The antenna of claim 10 wherein said feed array support structure includes a catenary feed support frame and a truss structure connected between said feed support frame and said reflector catenary support frame.

12. The antenna of claim 11 wherein said catenary feed support structure includes rigidizable components.

13. The antenna of claim 7 wherein said cylindrical wall and said feed array are configured to have an aperture that is about 55 meters in height and about 50 meters in length.

14. The antenna of claim 1 wherein said cylindrical wall has a radius of about 55 meters.

15. The antenna of claim 7 wherein said feed array is located about 26 meters from a vertex of said cylindrical wall.

16. A space deployable antenna comprising:

an inflatable flexible enclosed envelope having a cylindrical wall transparent to RF;

said cylindrical wall ending at first and second opposing edges;

an RF reflective coating disposed on said cylindrical wall;

a deployable catenary reflector support frame that when deployed supports said first and second edges and maintains said cylindrical wall in a cylindrical shape when said envelope is inflated; and a deployable feed array support structure connected to said catenary support frame for supporting a deployable feed array for illuminating said RF reflective coating with RF energy.

17. The antenna of claim 16 wherein said catenary reflector support frame includes catenary supports.

18. The antenna of claim 17 wherein said catenary reflector support frame includes extendable, rigidizable components.

19. The antenna of claim 16 wherein said feed array support structure includes a catenary feed array support frame for supporting said feed array.

20. The antenna of claim 19 wherein said catenary feed support frame includes extendable, rigidizable components.

21. The antenna of claim 16 wherein said cylindrical wall and said feed array support structure are configured for an aperture that is about 55 meters in height and about 50 meters in length when deployed.

22. The antenna of claim 16 wherein said cylindrical wall has a radius of about 55 meters when deployed, an d said feed array is located about 26 meters from a vertex of said cylindrical wall when deployed.

23. The antenna of claim 16, further comprising a micrometeor shield disposed within said envelope.

24. The antenna of claim 16, wherein said feed array support structure further includes a deployable truss structure connected between said feed support structure and said reflector catenary support frame for supporting the feed support frame at said focal location.

* * * * *